US011208811B2

(12) United States Patent
Castel

(10) Patent No.: US 11,208,811 B2
(45) Date of Patent: Dec. 28, 2021

(54) COVERING DEVICE WITH MOBILE PANELS, IN PARTICULAR FOR A PERGOLA

(71) Applicant: SOLISYSTEME, Avanton (FR)

(72) Inventor: Jean-Louis Castel, Poitiers (FR)

(73) Assignee: SOLISYSTEME, Avanton (FR)

( * ) Notice: Subject to any disclaimer, the term of this patent is extended or adjusted under 35 U.S.C. 154(b) by 0 days.

(21) Appl. No.: 16/641,040

(22) PCT Filed: Aug. 20, 2018

(86) PCT No.: PCT/EP2018/072431
§ 371 (c)(1),
(2) Date: Feb. 21, 2020

(87) PCT Pub. No.: WO2019/038229
PCT Pub. Date: Feb. 28, 2019

(65) Prior Publication Data

US 2021/0032870 A1 Feb. 4, 2021

(30) Foreign Application Priority Data

Aug. 22, 2017 (FR) ..... 1770879

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04H 3/12; E04H 3/123
USPC ..... 160/61; 52/9
See application file for complete search history.

(56) References Cited

U.S. PATENT DOCUMENTS 2,094,801 A * 10/1937 Mass ..... E04B 7/166 52/64
2,895,183 A * 7/1959 Dumbolton ..... E05D 15/08 160/197
3,443,265 A * 5/1969 Hauck ..... E04H 3/16 4/498
4,616,451 A * 10/1986 Glick ..... E04B 7/166 49/125
5,063,730 A * 11/1991 Muramoto ..... E04B 1/34305 56/66
5,559,411 A * 9/1996 Winship ..... E04H 3/123 297/16.2
6,430,879 B1 * 8/2002 Nuiry ..... E04B 1/34305 4/498

(Continued)

FOREIGN PATENT DOCUMENTS

DE 102012221860 A1 6/2014
EP 2817463 B1 12/2015

(Continued)

OTHER PUBLICATIONS

International Search Report, dated Nov. 9, 2018, from corresponding PCT application No. PCT/EP2018/072431.

*Primary Examiner* — Beth A Stephan
(74) *Attorney, Agent, or Firm* — Nixon & Vanderhye

(57) ABSTRACT

Disclosed is a covering device with mobile panels, in particular for a pergola, including a support, cover, and positioning unit. The cover is made up of transversely folded panels, vertically stacked, and the positioning unit is made up of slides rigidly connected to the panels, oriented in a single direction, and rollers supporting the slides.

4 Claims, 2 Drawing Sheets

(56) References Cited

U.S. PATENT DOCUMENTS

| | | | | |
|---|---|---|---|---|
| 7,900,402 | B2 * | 3/2011 | Staten | E04H 3/126<br>52/10 |
| 8,701,356 | B2 * | 4/2014 | Forsland | E04B 1/19<br>52/66 |
| 9,140,014 | B2 | 9/2015 | Castel | |

FOREIGN PATENT DOCUMENTS

| | | | |
|---|---|---|---|
| ES | 2083322 | A2 | 4/1996 |
| FR | 2676079 | A1 | 11/1992 |
| JP | S55-155852 | A | 12/1980 |
| JP | S57-68002 | U | 4/1982 |
| WO | 2013/124594 | A1 | 8/2013 |

* cited by examiner

COVERING DEVICE WITH MOBILE PANELS, IN PARTICULAR FOR A PERGOLA

BACKGROUND OF THE INVENTION

Field of the Invention

This invention proposes a covering device with mobile panels, in particular for a pergola.

DESCRIPTION OF THE RELATED ART

In the field of exterior layout and solar comfort, numerous approaches exist to allow modular shading. The simplest and most common approach is the awning that can be rolled up and unrolled and that is in general attached to the wall and is deployed over a given, adjustable length with a fixed, non-modular width.

To protect a terrace, for example, the roll-up awning has a limited extending capacity, limited aesthetics, and remains a flexible structure whose wind resistance is limited. Actually, the awning is an element in cantilever, equipped with structural arms whose wind resistance capacity is limited.

For the manual awnings, it is therefore necessary to monitor wind speed and to retract the awning if necessary. In the case of an electrically-powered awning, a wind sensor can be installed to start the engine and to retract the awning if the wind force is too high.

In addition, the awnings are not designed to protect a terrace from rain and thus limit the use of the terrace when it rains.

Pergolas are known that are rigid structures that offer high wind resistance and that are installed in a stationary manner above the area to be shaded. However, although the structural advantage of a pergola is indisputable, the fact that it constitutes a permanent rigid structure may not be suitable. Actually, there are even entirely advantageous pergolas with adjustable slats that can allow the majority of the light to pass through but that can also be closed to form a watertight surface when it rains.

Such a pergola, with adjustable slats, is described in French Patent FR 2 676 079, in the name of and on behalf of the same applicant.

The permanent presence of slats, even adjustable slats, generates permanent shading above the area that is located below the pergola, but this permanent shading may not be suitable for certain applications, certain geometric arrangements of terraces, certain solar orientations, or certain choices of the users. In addition, it is necessary to maneuver the panels based on the movements of the sun as said sun moves over the course of the day.

Certain users wish to use a pergola that is watertight but that can be uncovered over its larger surface for less sunny days for example, or in winter so as to allow maximum sunlight to pass through.

A known approach proposes surface modules that are mounted to slide in rails in two intersecting directions X, Y; this approach, as well as its arrangement, is described in European Patent EP 2 817 463, in the name of and on behalf of the same applicant.

This arrangement addresses the problem that is posed with a high level of modularity because the surface modules can be stacked by individual maneuvering of said surface modules. Nevertheless, it may be useful in certain cases to use a pergola in which the movement of one module ensures the movement of the others, at the expense of any modularity but to allow easier manufacturing and simpler handling for the user, by maintaining the possibility of a significant uncovering.

It would be advantageous to be able to use the advantages of a flexible awning, in particular advantages linked to its ease of folding-up and of deployment while preserving the rigidity and the resistance to wind and rain, in order to be able to ensure sealing.

SUMMARY OF THE INVENTION

This invention proposes a rigid awning that can be retracted by stacking and that slides over a rigid structure, which makes possible the easy and simultaneous maneuverability of multiple modules.

BRIEF DESCRIPTION OF THE DRAWINGS

This invention is now described according to a principal embodiment, without the latter being limiting, relative to the accompanying drawings in which the various figures show.

DESCRIPTION OF THE PREFERRED EMBODIMENTS

Figure 1:
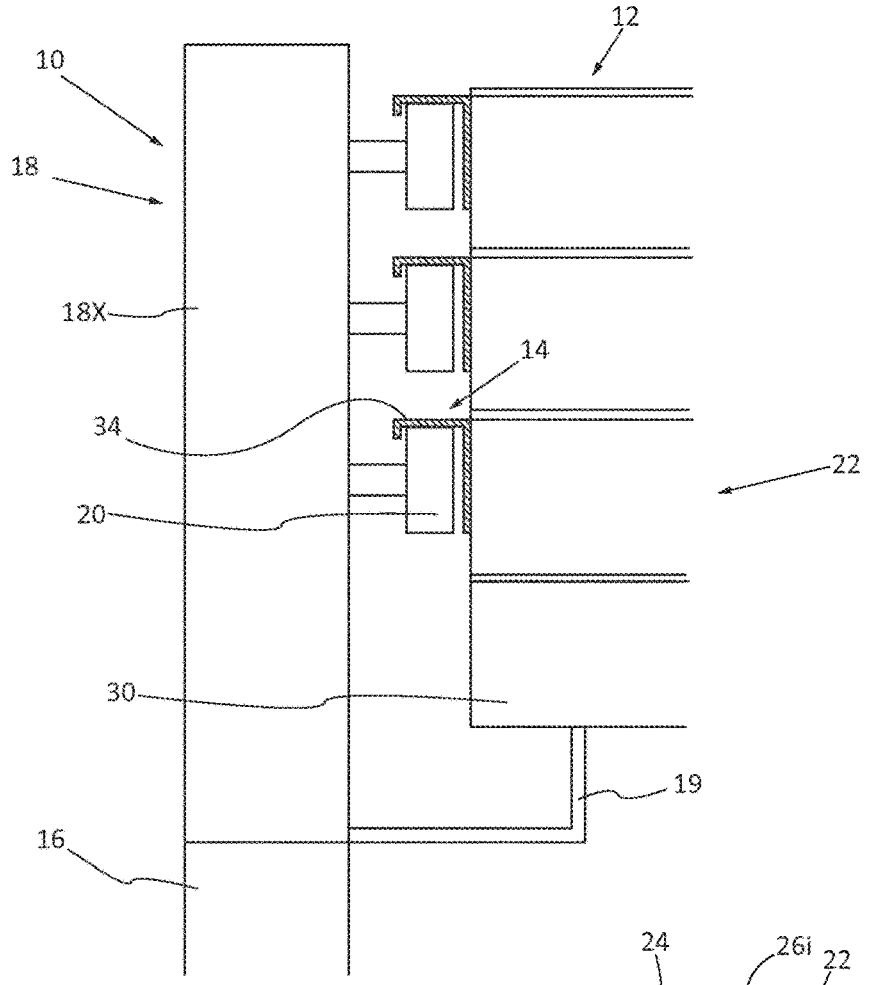
FIG. 1: a front view of the covering device with mobile panels.
Figure 2:
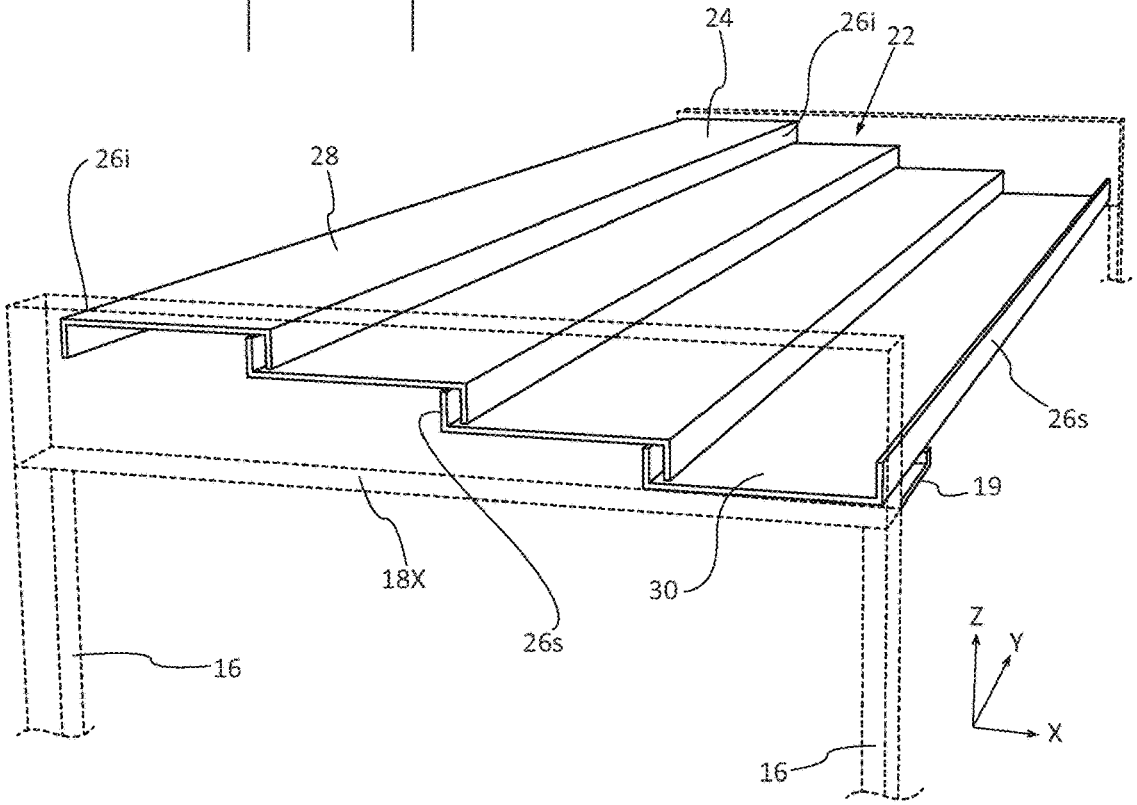
FIG. 2: a perspective view of the mobile panels of the covering device.

The orthonormal reference point X, Y, Z is considered for all of the FIGS. 1, 2, and 3. FIG. 1 shows a covering device with mobile panels, comprising means 10 for holding said cover, covering means 12, and means 14 for positioning said covering means.

The means 10 for holding the cover are formed by vertical posts 16 and a horizontal frame 18. The horizontal frame 18, more specifically the two elements 18X of the frame 18 that are extended along axis X, support a gutter 19 and rollers 20. The rollers 20 that can be seen in FIG. 1 are mounted to move in rotation relative to said elements 18X. More specifically, the two elements 18X of the frame 18 support three lines of stacked rollers 20, along axis Z.

The covering means 12 are made up of at least three panels 22, in this case four panels 22 in the embodiment that is shown.

These panels 22 are vertically stacked.

Each of the panels 22 is bent and made of thermolaquered metal, for example, but it could be shaped and molded, and made of composite materials, for example.

Each bent panel 22 comprises three surfaces: a horizontal surface 24, vertical surfaces 26*i*, 26*s* that are oriented downward 26*i* and/or vertical surfaces that are oriented upward 26*s*. The vertical surfaces that are oriented downward 26*i* and/or upward 26*s* are assumed to be in the plane Y, Z, with the bending axis being oriented along axis Y.

In the case of an embodiment with at least three panels, three types of bent panels 22 are used:

A mobile upper end panel 28,

A stationary lower end panel 30,

At least one mobile intermediate panel 32-1, 32-2.

The upper end panel 28 comprises a horizontal surface 24 and two vertical surfaces 26*i*, 26*s* that are oriented downward 26*i*.

The bent panel 22, provided with a horizontal surface 24 and two vertical surfaces 26*s* that are oriented upward 26*s*, forms the lower end panel 30.

Each intermediate panel 32-1, 32-2 is made up of a horizontal surface 24, a vertical surface 26*i* that is oriented downward, and a vertical surface 26*s* that is oriented upward. The vertical surface 26*s* that is oriented upward is located on the upstream side, i.e., on the side of the upper end panel 28.

The arrangement of the bent panels 22 is such that, along axis X, the upper end panel 28, the two intermediate panels 32-1 and 32-2, and the lower end panel 30 are arranged in the following way:

Upper end panel 28 on the top,

First intermediate panel 32-1 under the upper end panel 28,

Second intermediate panel 32-2 under the first intermediate panel 32-1, and Lower end panel 30 under the second intermediate panel 32-2.

Figure 3A:
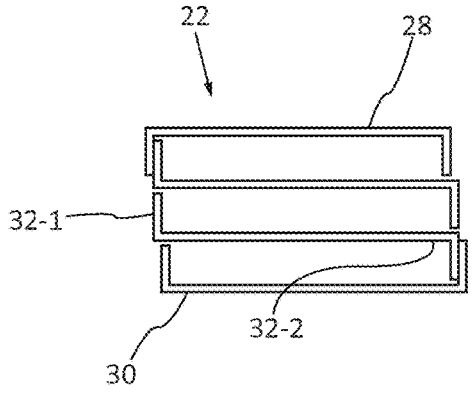
FIGS. 3A to 3C: a diagrammatic side elevation view of a block diagram for deployment of the covering device.
Figure 3B:
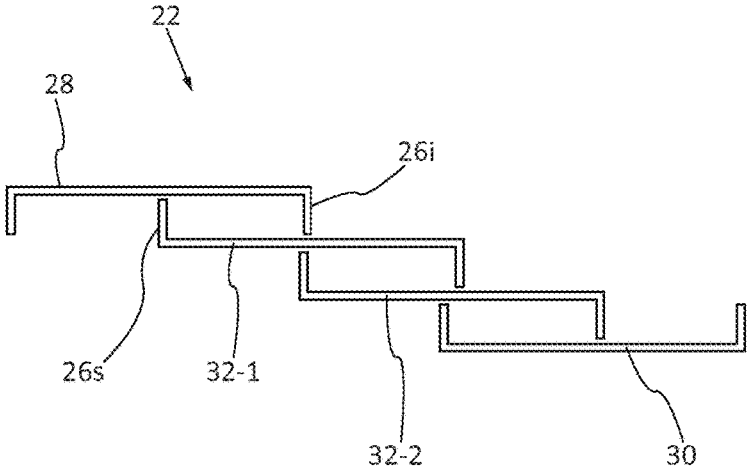

The various bent panels 22 are thus arranged in a descending manner along axis X in stair-step form when the panels 22 are unfolded, as shown in FIG. 3B.

The positioning means 14 are made up of a slide 34 that is attached along axis X, at each respective end, assumed to be along axis Y, of the at least one intermediate panel 32-1, 32-2 and the lower end panel 30. Actually, the lower end panel 30 is stationary and integral with the elements 18X, by means of the gutters 19. Said slides 34 form a hollow rail, with an upside-down U profile, able to rest on the rollers 20.

The slides 34 make possible translational displacements of the covering panels only in the direction X.

So as to facilitate the visualization of the interlocking of the bent panels 22, FIG. 2 shows only the bent panels 22 of the device with mobile panels. FIG. 2 corresponds to the perspective view of FIG. 3B of the block diagram.

Figure 3C:
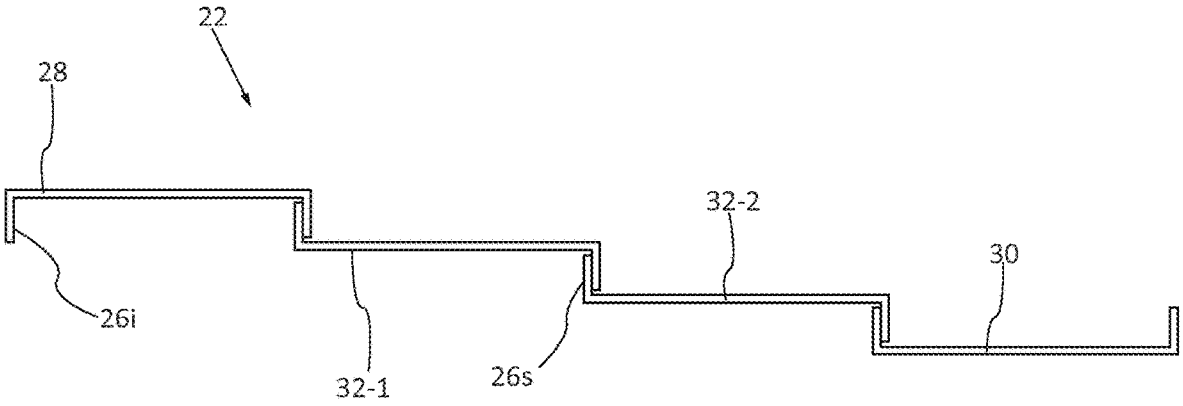

FIGS. 3A, 3B, 3C show a block diagram for deployment of the covering device with mobile panels. So as to facilitate the understanding of the block diagram, FIGS. 3A, 3B, 3C show only the bent panels 22 of the covering device.

The elevation view of the block diagram of FIG. 3 shows the deployment of the upper end panel 28, the intermediate panels 32-1 and 32-2, and the lower end panel 30.

FIG. 3A shows the folded-up covering device, FIG. 3B shows the partially-deployed covering device, and FIG. 3C shows the completely-deployed covering device.

This invention is now described in even more detail.

The holding means 10 that are formed by the vertical posts 16 and the horizontal frame 18 make it possible to hold the positioning means 14 and the bent panels 22. Actually, the two elements 18X support the rollers 20, whose axis of rotation is horizontal and oriented along axis Y. As can be seen in the front view of FIG. 1, the rollers 20 that are attached to the elements 18X support the bent panels 22 by means of the slides 34. The slides 34, in an upside-down U, i.e., with the hollow that is produced facing downward and whose longitudinal axis is along axis X, rest on the rollers 20 and make it possible to hold the bent panels 22 and at the same time allow the possibility of moving the bent panels 22 along axis X, by making them roll on the rollers 20.

Thus, the bent panels 22, by means of their respective slides 34, roll on the rollers 20, along axis X.

Each of the bent panels 22, in this case the upper end panel 28, the intermediate panels 32-1 and 32-2, and the lower end panel 30, can thus be positioned at the user's request. Because of the geometry of the bent panels 22, each of which comprises vertical surfaces (flanges) 26*i*, 26*s*, the movement of a bent panel 22 entrains the other bent panel 22. Actually, the vertical flanges 26*i* and 26*s* are stacked in the plane Z, Y such that the vertical flange 26*i* of a bent panel 22 that is placed on the top and the vertical flange 26*s* of the bent panel 22 that is placed on the bottom are positioned at the same height, assumed to be along axis Z. Nevertheless, play at the vertical end of the vertical panels 26*i* and 26*s* and along axis Z is assumed for facilitating the positioning of the bent panels 22. This play measures several millimeters here.

Although, in the case shown here, the upper end panel 28 is mobile and the lower end panel 30 is stationary, it would be possible to make the upper end panel 28 stationary and the lower end panel 30 mobile.

Thus, when the bent panels 22 are moved along axis X and along a distance that is greater than the width of a horizontal panel 24, said bent panels 22 entrain the bent panel that is positioned on the top or on the bottom, by means of the respective vertical flanges 26*i*, 26*s*.

There is thus a very large number of positioning options of the various bent panels 22, in addition to the totally open or totally folded-up end positions.

These various positioning options make it possible to adjust as well as possible the bent panels 22 based on the desired shading effect that can thus be partial or total.

FIG. 3 shows three different positions. The more the bent panels 22 are stacked up, the more the shading or covering surface is reduced. The shading or covering surface is maximal when all of the vertical flanges 26*i*, 26*s* are in contact.

In the event of rain, the full-open positioning of the bent panels 22 ensures a flow of water from the upper end panel 28 to the lower end panel 30. Actually, the vertical flange 26*i* that is oriented downward of a panel 22 is placed on the side of the bent panel 22 that is positioned at the bottom and thus facilitates the flow of the water.

To evacuate water laterally, i.e., along axis Y, the gutters 19, extended along axis X and placed laterally under the side edges of the bent panels 22 thus ensure the evacuation of the water laterally.

Because of the geometry of the bent panels 22, the movement of one of the bent panels 22 over a distance that is greater than the space between two vertical flanges 26 entrains the panel at the top or at the bottom.

Actually, the vertical flanges 26*i* and 26*s* are such that any movement along axis X of a bent panel 22 over a distance that is greater than the space between two vertical flanges 26*i*, 26*s* of a bent panel 22 entrains the bent panel 22 that is placed at the top or at the bottom and thus ensures a physical continuity of the bent panels 22 in the plane X, Y. Each panel 22 therefore has the possibility of entraining the bent panel 22 from the top and the bent panel 22 from the bottom by means of the respective vertical panels 26*i*, 26*s*. Any discontinuity of the bent panels 22 in the plane X, Y is not possible, regardless of the position of said bent panels 22. The minimum covering length is equal to the X dimension of a panel, and the maximum covering length is equal to the sum of the bent panels 22, minus the thickness of the vertical flanges 26*i*, 26*s*.

Although the device is described here with four bent panels, it is, of course, possible to multiply the number of intermediate panels to increase the covering surface.

The invention claimed is:

1. A covering device the covering device comprising:

a holder;

a cover comprising at least three bent panels, each of the bent panels having a horizontal surface and two flanges extending away from the horizontal surface, the bent panels being slidable with respect to each other such that the panels are configured to be vertically stacked, the at least three bent panels including a mobile upper end panel, a stationary lower end panel, and at least one mobile intermediate panel, the flanges of the mobile upper end panel extending downward from the horizontal surface of the mobile upper end panel, the flanges of the stationary lower end panel extending upward from the horizontal surface of the stationary lower end panel, one of the flanges of the at least one mobile intermediate panel extending upward from the horizontal surface of the respective at least one mobile intermediate panel and the other one of the flanges of the at least one mobile intermediate panel extending downward from the horizontal surface of the respective at least one mobile intermediate panel, at least one of the upwardly-extending flanges of the at least one mobile intermediate panel being configured to engage one of the flanges of the mobile upper end panel, at least one of the downwardly-extending flanges of the at least one mobile intermediate panel being configured to engage one of the flanges of the stationary lower end panel, a positioning system comprising slides that are integral with said bent panels, the slides being oriented in a single direction, and rollers that are integral with the holder, the rollers supporting said slides; and gutters, disposed laterally under the side edges of the bent panels, thus ensuring evacuation of water laterally.

2. The covering device according to claim 1, wherein the upwardly-extending flange extending of each of the at least one mobile intermediate panel is located on an upstream side, on a side of the mobile upper end panel.

3. The covering device according to claim 1, wherein the covering device is for a pergola.

4. The covering device according to claim 1, wherein the at least one mobile intermediate panel comprises a plurality of mobile intermediate panels, and the downwardly-extending flange of a first one of the mobile intermediate panels is configured to engage the upwardly-extending flange of a second one of the mobile intermediate panels.

* * * * *